US007244321B2

(12) United States Patent
Kim et al.

(10) Patent No.: US 7,244,321 B2
(45) **Date of Patent: *Jul. 17, 2007**

(54) IN-SITU DUCTILE METAL/BULK METALLIC GLASS MATRIX COMPOSITES FORMED BY CHEMICAL PARTITIONING

(75) Inventors: Choong Paul Kim, Northridge, CA (US); Charles C. Hays, Pasadena, CA (US); William L. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 288 days.

This patent is subject to a terminal disclaimer.

(21) Appl. No.: 10/735,148

(22) Filed: Dec. 12, 2003

(65) Prior Publication Data

US 2007/0131312 A1 Jun. 14, 2007

Related U.S. Application Data

(63) Continuation of application No. 09/890,480, filed on Apr. 2, 2002, now Pat. No. 6,709,536.

(60) Provisional application No. 60/131,973, filed on Apr. 30, 1999.

(51) Int. Cl.
*C22C 45/00* (2006.01)

(52) U.S. Cl. ..... 148/561; 148/421

(58) Field of Classification Search ..... 148/561
See application file for complete search history.

(56) References Cited

U.S. PATENT DOCUMENTS 5,288,344 A 2/1994 Peker et al.

5,368,659 A 11/1994 Peker et al.

(Continued)

FOREIGN PATENT DOCUMENTS

WO WO 00/68469 11/2000

OTHER PUBLICATIONS

Aggarwala, B.D. et al.; *Tempering Stresses in an Infinite Glass Plate*; Physics and Chemistry of Glasses; vol. 2, No. 5; Oct. 1961; pp. 137-140.

(Continued)

*Primary Examiner*—George P. Wyszomierski
(74) *Attorney, Agent, or Firm*—Christie, Parker & Hale, LLP

(57) ABSTRACT

A composite metal object comprises ductile crystalline metal particles in an amorphous metal matrix. An alloy is heated above its liquidus temperature. Upon cooling from the high temperature melt, the alloy chemically partitions, forming dendrites in the melt. Upon cooling the remaining liquid below the glass transition temperature it freezes to the amorphous state, producing a two-phase microstructure containing crystalline particles in an amorphous metal matrix. The ductile metal particles have a size in the range of from 0.1 to 15 micrometers and spacing in the range of from 0.1 to 20 micrometers. Preferably, the particle size is in the range of from 0.5 to 8 micrometers and spacing is in the range of from 1 to 10 micrometers. The volume proportion of particles is in the range of from 5 to 50% and preferably 15 to 35%. Differential cooling can produce oriented dendrites of ductile metal phase in an amorphous matrix. Examples are given in the Zr—Ti—Cu—Ni—Be alloy bulk glass forming system with added niobium.

13 Claims, 6 Drawing Sheets

U.S. PATENT DOCUMENTS

| | | | | |
|---|---|---|---|---|
| 5,567,251 | A | 10/1996 | Peker et al. | |
| 5,589,012 | A | 12/1996 | Hobby et al. | |
| 5,735,975 | A | 4/1998 | Lin et al. | |
| 5,866,254 | A | 2/1999 | Peker et al. | |
| 6,709,536 | B1 * | 3/2004 | Kim et al. | 148/561 |

OTHER PUBLICATIONS

Aydiner, C.C., et al.; *Thermal Tempering Analysis of Bulk Metallic Glass Plates Using an Instant Freezing Model*; pp. 1-21.

Bakke, E. et al.; *The Viscosity of the $Zr_{46.75}Ti_{8.25}Cu_{7.5}Ni_{10}Be_{27.5}$ bulk metallic glass forming alloy in the supercooled liquid*; Appl. Phys. Lett; vol. 67, No. 22; Nov. 27, 1995; pp. 3260-3262.

Bartenev, D.M.; *The Phenomemon of the Quenching of Glass*; (Translation) vol. 18, 1948; pp. 1-9.

Bartenev, D.M.; *The Theory of the Mechanical Strengthening of Glass by Quenching*; (Translation) vol. 60, No. 2, 1948; pp. 257-260.

Bartholomew, Roger F. et al.; *Chemical Strengthening of Glass*; Chapter 6; 1980; Academic Press, Inc.; pp. 217-270.

Brown, James Ward et al.; *Fourier Series and Boundary Value Problems*; Fifth Edition; McGraw-Hill, Inc: New York; pp. 193-197.

Bruck, H.A. et al.; *Quasi-Static Constitutive Behavior of $Zr_{41.25}Ti_{13.75}Nu_{10}Cu_{12.5}Be_{22.5}$ Bulk Amorphous Alloys*; Scripta Metallurgica et Materialia; vol. 30; 1994; pp. 429-434.

Carre, H et al.; *Numerical Simulation of Soda-Lime Silicate Glass Tempering*; Journal De Physique IV; vol. 6; Jan. 1996; pp. 175-185.

Choi-Yim, H. et al.; *Synthesis and Characterization of Particulate Reinforced $Zr_{57}Nb_5Al_{10}Cu_{15.4}Ni_{12.6}$ Bulk Metallic Glass Composites*; Acta mater; vol. 47, No. 8; 1999; pp. 2455-2462.

Conner, R.D. et al.; *Dynamic deformation behavior of tungsten-fiber/metallic-glass matrix composites*; International Journal of Impact Engineering; vol. 24; 2000; pp. 435-444.

Conner, R.D. et al.; *Mechanical Properties of Tungsten and Steel Fiber Reinforced $Zr_{41.25}Ti_{13.75}Cu_{12.5}Ni_{10}Be_{22.5}$ Metallic Glass Matrix Composites*; Acta Mater; vol. 46, No. 17; 1998; pp. 6089-6102.

Conner, R.D. et al.; *Mechanical Properties of $Zr_{57}Nb_5Al_{10}Cu_{15.4}Ni_{12.6}$ metallic glass matrix particulate composites*; J. Mater. Res.; vol. 14, No. 8; Aug. 1999; Materials Research Society; pp. 3292-3297.

Dandliker, R.D. et al.; *Melt infiltration casting of bulk metallic-glass matrix composites*; J. Mater. Res.; vol. 13, No. 10; Oct. 1998; Materials Research Society; pp. 2896-2901.

De Jong, M. et al.; *The relaxation of internal stresses during annealing of amorphous $Fe_{40}Ni_{40}B_{20}$*; Materials Science and Engineering; A179/A180; 1994; p. 341-345.

Gardon, Robert; *Thermal Tempering of Glass, What is Tempered Glass*, pp. 146-216.

Gilbert, C.J. et al.; *Fracture toughness and fatigue-crack propagation in a Zr-Ti-Ni-Cu-Be bulk metallic glass*; Appl. Phys. Lett; vol. 71, No. 4; Jul. 28, 1997; pp. 476-478.

Hays, C.C. et al.; *Enhanced Plasticity of Bulk Metallic Glasses Containing Ductile Phase Dendrite Dispersions*; Materials Science Forum; vols. 343-346; 2000; pp. 191-196.

Hays, C.C. et al.; *Microstructure Controlled Shear Band Pattern Formation and Enhanced Plasticity of Bulk Metallic Glasses Containing in situ Formed Ductile Phase Dendrite Dispersions*; The American Physical Society; vol. 84, No. 13; Mar. 27, 2000; pp. 2901-2904.

Holman, J.P.; *Heat Transfer*; Sixth Edition; 1-3 Convection Heat Transfer; McGraw-Hill Book Company: New York; pp. 10-14.

Indenbom, V.L.; *On the Theory of the Quenching of Glass* (translation); vol. 24; 1954; 4 pp.

Indenbom, V.L. et al.; *Thermoplastic and Structural Stresses in Solids*; Soviet Physics—Solid State; vol. 6, No. 4; 1964; pp. 767-772.

Kitaigorodski, F.I. et al.; *Strengthening of Glass by Quenching*; vol. 108; 1956; pp. 843-845.

Lee, E.H. et al.; *Residual Stresses in a Glass Plate Cooled Symmetrically from Both Surfaces*; Journal of the American Ceramic Society; vol. 48, No. 9; pp. 480-487.

Leng, Y. et al.; *Multiple shear band formation in metallic glasses in composites*; Journal of Materials Science; vol. 26; 1991; pp. 588-592.

Liu, Wenshan et al.; *Precipitation of bcc nanocrystals in bulk Mg-Cu-Y amorphous alloys*; J. Mater. Res.; vol. 11, No.; Sep. 1996; pp. 2388-2392.

Liu, W. et al.; *Small-angle x-ray-scattering study of phase separation and crystallization in the bulk amorphous $Mg_{62}Cu_{25}Y_{10}Li_3$ alloy*; The American Physical Society; vol. 59, No. 18; May 1, 1999; pp. 755-759.

Narayanaswamy, O.S.; *A Model of Structural Relaxation in Glass*; Journal of the American Ceramic Society; vol. 54, No. 10; pp. 491-498.

Narayanaswamy, O.S. et al.; *Calculation of Residual Stresses in Glass*; Journal of the American Ceramic Society; vol. 52, No. 10; pp. 554-558.

Ohsaka, K. et al.; *Specific volumes of the $Zr_{41.2}Ti_{13.8}Cu_{12.5}Ni_{10.0}Be_{22.5}$ alloy in the liquid glass, and crystalline states*; Appl. Phys. Lett.; vol. 70, No. 6; Feb. 10, 1997; pp. 726-728.

Peker, A. et al.; *A highly processable metallic glass: $Zr_{41.2}Ti_{13.8}Cu_{12.5}Ni_{10.0}Be_{22.5}$*; Appl. Phys. Lett.; vol. 63, No. 17; Oct. 25, 1993; pp. 2342-2344.

Seifert, Wolfgang et al.; *Glass transition and instant freezing theories—A Comparison of frozen-in temper stresses*; Glastech. Ber. Glass Sci. Technol.; vol. 71, No. 12; 1998; pp. 341-351.

Tejedor, M. et al.; *Mechanical determination of internal stresses in as-quenched magnetic amorphous metallic ribbons*; Journal of Materials Science; vol. 32; 1997; pp. 2337-2340.

Yanniotis, S. et al; *Boiling on the Surface of a Rotating Disc*; Journal of Food Engineering; vol. 30; 1996; pp. 313-325.

* cited by examiner

IN-SITU DUCTILE METAL/BULK METALLIC GLASS MATRIX COMPOSITES FORMED BY CHEMICAL PARTITIONING

CROSS-REFERENCE TO RELATED APPLICATION(S)

This application claims benefit of priority of U.S. Patent Application No. 60/131,973, and is a continuation of Application No. 09/890,480, filed Jul. 31, 2001 now U.S. Pat. No. 6,709,536, issued Mar. 23, 2004, which is incorporated herein by this reference.

STATEMENT REGARDING FEDERALLY SPONSORED RESEARCH OR DEVELOPMENT

The U.S. Government has certain rights in this invention pursuant to Grant No. DE-FG03-89ER452 421 awarded by the Department of Energy, and Grant No. 5F 4920-97-1-0323 awarded by the Air Force Office of Scientific Research.

BACKGROUND

Metallic glasses fail by the formation of localized shear bands, which leads to catastrophic failure. Metallic glass specimens that are loaded in a state of plane stress fail on one dominant shear band and show little inelastic behavior. Metallic glass specimens loaded under constrained geometries (plane strain) fail in an elastic-perfectly-plastic manner by the generation of multiple shear bands. Multiple shear bands are observed when the catastrophic instability is avoided via mechanical constraint; e.g., in uniaxial compression, bending, drawing, and under localized indentation. There are a number of models that attempt to describe the formation of shear bands in metallic glasses, and at present these models do not fully describe the experimental observations.

A new class of ductile metal reinforced bulk metallic glass matrix composite materials has been prepared that demonstrate improved mechanical properties. This newly designed engineering material exhibits both improved toughness and a large plastic strain to failure. The new material was designed for use in structural applications (aerospace and automotive, for example), and is also a promising material for application as an armor.

BRIEF SUMMARY OF THE INVENTION

There is provided in practice of this invention, a method for forming a composite metal object comprising ductile crystalline metal particles in an amorphous metal matrix. An alloy is heated above the melting point of the alloy, i.e. above its liquidus temperature. Upon cooling from the high temperature melt, the alloy chemically partitions; i.e., undergoes partial crystallization by nucleation and subsequent growth of a crystalline phase in the remaining liquid. The remaining liquid, after cooling below the glass transition temperature (considered as a solidus) freezes to the amorphous or glassy state, producing a two-phase microstructure containing crystalline particles (or dendrites) in an amorphous metal matrix; i.e., a bulk metallic glass matrix.

This technique may be used to form a composite amorphous metal object having all of its dimensions greater than one millimeter. Such an object comprises an amorphous metal alloy forming a substantially continuous matrix, and a second ductile metal phase embedded in the matrix. For example, the second phase may comprise crystalline metal dendrites having a primary length in the range of from 30 to 150 micrometers and secondary arms having a spacing between adjacent arms in the range of from 1 to 10 micrometers, more commonly in the order of about 6 to 8 micrometers.

In a preferred embodiment the second phase is formed in situ from a molten alloy having an original composition in the range of from 52 to 68 atomic percent zirconium, 3 to 17 atomic percent titanium, 2.5 to 8.5 atomic percent copper, 2 to 7 atomic percent nickel, 5 to 15 atomic percent beryllium, and 3 to 20 atomic percent niobium. Other metals that may be present in lieu of or in addition to niobium are selected from the group consisting of tantalum, tungsten, molybdenum, chromium and vanadium. These elements act to stabilize bcc symmetry crystal structure in Ti- and Zr-based alloys.

DRAWINGS

DESCRIPTION

The remarkable glass forming ability of bulk metallic glasses at low cooling rates (e.g., less than about $10^3$ K/sec) allows for the preparation of ductile metal reinforced composites with a bulk metallic glass matrix via in situ processing; i.e., chemical partitioning. The incorporation of a ductile metal phase into a metallic glass matrix yields a constraint that allows for the generation of multiple shear bands in the metallic glass matrix. This stabilizes crack growth in the matrix and extends the amount of strain to failure of the composite. Specifically, by control of chemical composition and processing conditions, a stable two-phase composite (ductile crystalline metal in a bulk metallic glass matrix) is obtained on cooling from the liquid state.

In order to form a composite amorphous metal object by partitioning, one starts with a composition that may not, by itself, form an amorphous metal upon cooling from the liquid phase at reasonable cooling rates. Instead, the composition includes additional elements or a surplus of some of the components of an alloy that would form a glassy state on cooling from the liquid state.

A particularly attractive bulk glass forming alloy system is described in U.S. Pat. No. 5,288,344, the disclosure of which is hereby incorporated by reference. For example, to form a composite having a crystalline reinforcing phase and an amorphous matrix, one may start with an alloy in the bulk glass forming zirconium-titanium-copper-nickel-beryllium system with added niobium. Such a composition is melted so as to be homogeneous. The molten alloy is then cooled to a temperature range between the liquidus and solidus for the composition. This causes chemical partitioning of the composition into solid crystalline ductile metal dendrites and a liquid phase, with different compositions. The liquid phase becomes depleted of the metals crystallizing into the crystalline phase and the composition shifts to one that forms a bulk metallic glass at low cooling rate. Further cooling of the remaining liquid results in formation of an amorphous matrix around the crystalline phase.

Alloys suitable for practice of this invention have a phase diagram with both a liquidus and a solidus that each include at least one portion that is vertical or sloping, i.e. that is not at a constant temperature.

Figure 1:
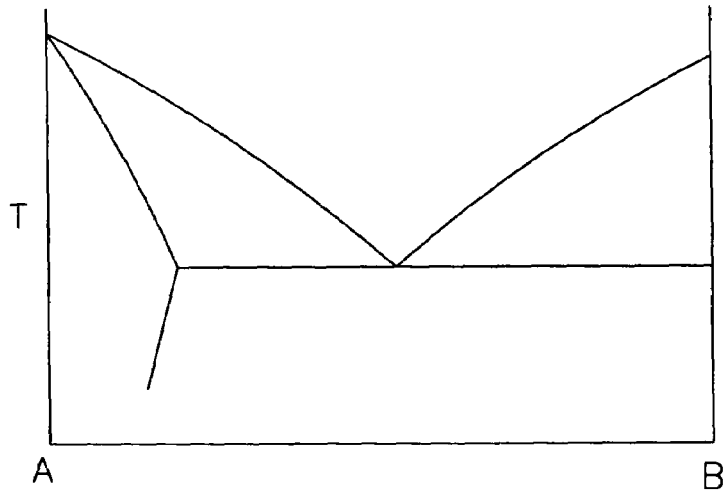
FIG. 1 is a schematic binary phase diagram.

Consider, for example, a binary alloy, AB, having a phase diagram with a eutectic and solid solubility of one metal A in the other metal B as shown in FIG. 1. In such an alloy system the phase diagram has a horizontal or constant temperature solidus line at the eutectic temperature extending from B to a point where B is in equilibrium with a solid solution of B in A. The solidus then slopes upwardly from the equilibrium point to the melting point of A. The liquidus line in the phase diagram extends from the melting point of A to the eutectic composition on the horizontal solidus and from there to the melting point of B. Thus, the solidus has a portion that is not at a constant temperature (between the melting point of A and the equilibrium point). The vertical line from the melting point of B to the eutectic temperature could also be considered a solidus line where there is no solid solubility of A in B. Likewise, the liquidus has sloping lines that are not at constant temperature. In a ternary alloy phase diagram there are solidus and liquidus surfaces instead of lines.

There are no binary or ternary alloys which are presently known to be suitable for practice of this invention. Suitable alloys are quaternary, quinary or even more complex mixtures. Such multidimensional phase diagrams are more difficult to visualize, but also have liquidus and solidus "surfaces". They can be represented in pseudo-binary and pseudo-ternary diagrams where one margin or corner of the diagram is itself an alloy rather than an element.

When referring to the solidus herein, it should be understood that this is not entirely the same as the solidus in a conventional crystalline metal phase diagram, for example. In usage herein, the solidus refers in part to a line (or surface) defining the boundary between liquid metal and a solid phase. This usage is appropriate when referring to the boundary between the melt and a solid crystalline phase precipitated for forming the phase embedded in the matrix. For the glass forming remainder of the melt the "solidus" is typically not at a well defined temperature, but is where the viscosity of the alloy becomes sufficiently high that the alloy is considered to be rigid or solid. Knowing an exact temperature is not important.

Figure 2:
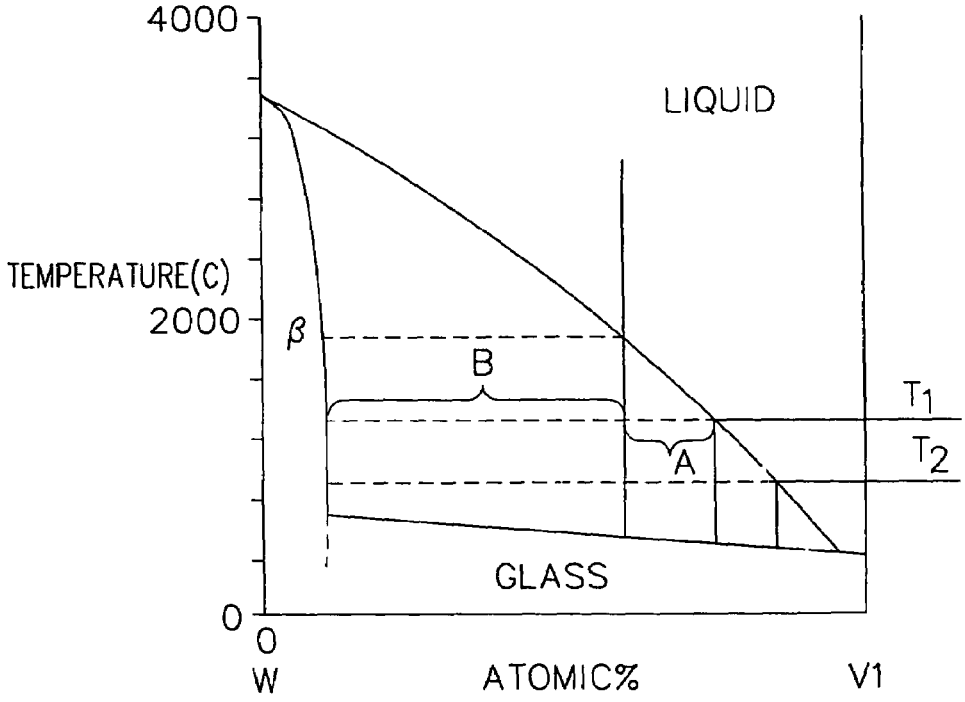
FIG. 2 is a pseudo-binary phase diagram of an exemplary alloy system for forming a composite by chemical partitioning.

Before considering alloy selection, we discuss the partitioning method in a pseudo-binary alloy system. FIG. 2 is a pseudo-binary phase diagram for alloys of M and X where X is a good glass forming composition, i.e. a composition that forms an amorphous metal at reasonable cooling rates. Compositions range from 100% M at the left margin to 100% of the alloy X at the right margin. An upper slightly curved line is a liquidus for M in the alloy and a steeply curving line near the left margin is a solidus for M with some solid solution of components of X in a body centered cubic M alloy. A horizontal or near horizontal line below the liquidus is, in effect, a solidus for an amorphous alloy. A vertical line in mid-diagram is an arbitrary alloy where there is an excess of M above a composition that is a good bulk glass forming alloy.

As one cools the alloy from the liquid, the temperature encounters the liquidus. A precipitation of bcc M (with some of the V1 components, principally titanium and/or zirconium, in solid solution) commences with a composition where a horizontal line from the liquidus encounters the solidus. With further cooling, there is dendritic growth of M crystals, depleting the liquid composition of M, so that the melt composition follows along the sloping liquidus line. Thus, there is a partitioning of the composition to a solid crystalline bcc, M-rich β phase and a liquid composition depleted in M.

At an arbitrary processing temperature $T_1$ the proportion of solid M alloy corresponds to the distance A and the proportion of liquid remaining corresponds to the distance B in FIG. 2. In other words, about ¼ of the composition is solid dendrites and the other ¾ is liquid. At equilibrium at a second processing temperature $T_2$ somewhat lower than $T_1$, there is about ⅓ solid crystalline phase and ⅔ liquid phase.

If one cools the exemplary alloy to the first or higher processing temperature $T_1$ and holds at that temperature until equilibrium is reached, and then rapidly quenches the alloy, a composite is achieved having about ¼ particles of bcc alloy distributed in a bulk metallic glass matrix having a composition corresponding to the liquidus at $T_1$. One can vary the proportion of crystalline and amorphous phases by holding the alloy at a selected temperature above the solidus, such as for example, at $T_2$ to obtain a higher proportion of ductile metallic particles.

Instead of cooling and holding at a temperature to reach equilibrium as represented by the phase diagram, one is more likely to cool from the melt continuously to the solid state. The morphology, proportion, size and spacing of ductile metal dendrites in the amorphous metal matrix is influenced by the cooling rate. Generally speaking, a faster cooling rate provides less time for nucleation and growth of crystalline dendrites, so they are smaller and more widely spaced than for slower cooling rates. The orientation of the dendrites is influenced by the local temperature gradient present during solidification. The preferred cooling rate for a desired dendrite morphology and proportion in a specific alloy composition is found with only a few experiments.

For example, to form a composite with good mechanical properties, and having a crystalline reinforcing phase embedded in an amorphous matrix, one may start with compositions based on bulk metallic glass forming compositions in the Zr—Ti—M—Cu—Ni—Be system, where M is niobium. Alloy selection can be exemplified by reference to FIG. 3 which is a section of a pseudo-ternary phase diagram with apexes of titanium, zirconium and X, where X is $Be_9Cu_5Ni_4$. A small circle is indicated near 42% Zr, 13% Ti and 45% X, which is a desirable bulk glass forming alloy composition.

There are at least two strategies for designing a useful composite of crystalline metal particles distributed in an amorphous matrix in this alloy system. Strategy 1 is based on systematic manipulations of the chemical composition of bulk metallic glass forming compositions in the Zr—Ti—Cu—Ni—Be system. Strategy 2 is based on the preparation of chemical compositions which comprise the mixture of additional pure metal or metal alloys with a good bulk metallic glass forming composition in the Zr—Ti—Cu—Ni—Be system.

Strategy 1: Systematic Manipulation of Bulk Metallic Glass Forming Compositions:

An excellent bulk metallic glass forming composition has been developed with the following chemical composition: $(Zr_{75}Ti_{25})_{55}X_{45}=Zr_{41.2}Ti_{13.8}Cu_{12.5}Ni_{10}Be_{22.5}$ expressed in atomic percent, and herein labeled as alloy V1. This alloy composition has a proportion of Zr to Ti of 75:25. It is represented on the ternary diagram at the small circle in the large oval.

Around the alloy composition V1 lies a large region of chemical compositions which form a bulk metallic glass object (an object having all of its dimensions greater than one millimeter) on cooling from the liquid state at reasonable rates. This bulk glass forming region (GFR) is defined by the oval labeled as GFR in FIG. 3. When cooled from the liquid state, chemical compositions that lie within this region are fully amorphous when cooled below the glass transition temperature.

The pseudo-ternary diagram shows a number of competing crystalline or quasi-crystalline phases which limit the bulk metallic glass forming ability. Within the GFR these competing crystalline phases are destabilized, and hence do not prevent the vitrification of the liquid on cooling from the molten state. However, for compositions outside the GFR, on cooling from the high temperature liquid state the molten liquid chemically partitions. If the composition is alloyed properly, it forms a good composite engineering material with a ductile crystalline metal phase in an amorphous matrix. There are compositions outside GFR where alloying is inappropriate and the partitioned composite may have a mixture of brittle crystalline phases embedded in an amorphous matrix. The presence of these brittle crystalline phases seriously degrades the mechanical properties of the composite material formed.

For example, toward the upper right of the larger GFR oval, there is a smaller oval partially overlapping the edge of the larger oval, and in this region a brittle $Cu_2ZrTi$ phase may form on cooling the liquid alloy. This is an embrittling phenomenon and such alloys are not suitable for practice of this invention. The regions indicated on this pseudo-ternary diagram are approximate and schematic for illustrating practice of this invention.

Figure 3:
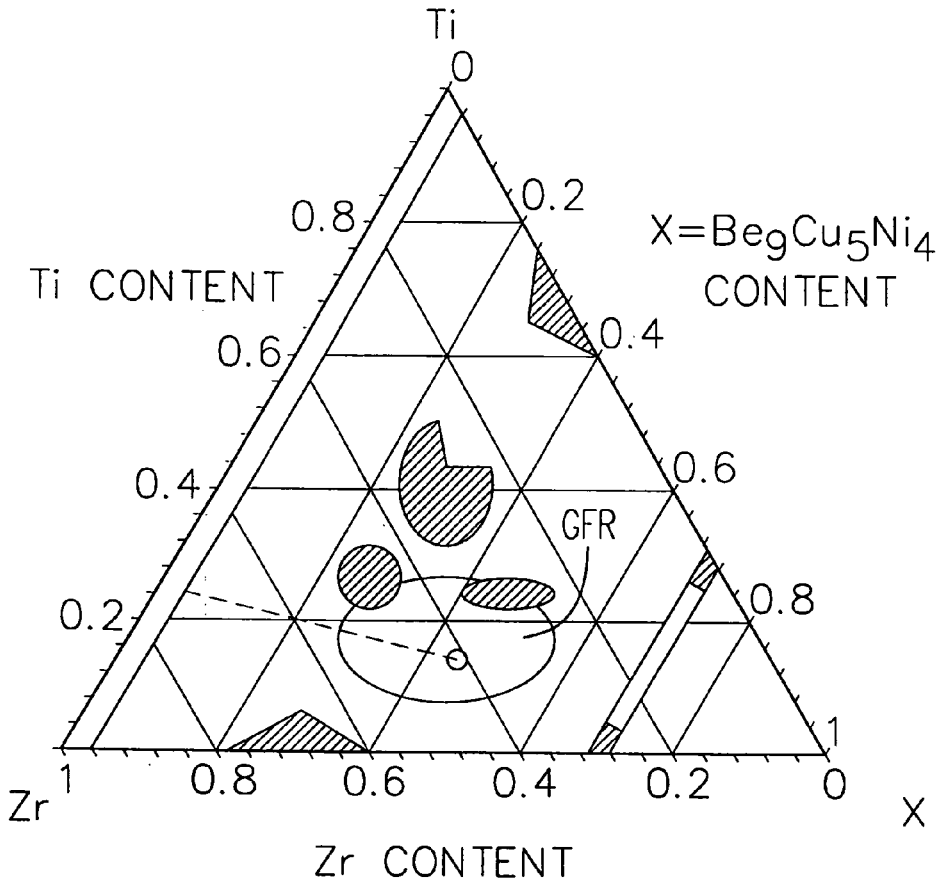
FIG. 3 is a pseudo-ternary phase diagram of a Zr—Ti—Cu—Ni—Be alloy system.

Above the left part of large GFR oval as illustrated in FIG. 3 there is a smaller circle representing a region where a quasi-crystalline phase forms, another embrittling phenomenon. An upper partial oval represents another region where a NiTiZr Laves phase forms. A small triangular region along the Zr—X margin represents formation of intermetallic $TiZrCu_2$ and/or $Ti_2Cu$ phases. Small regions near 70% X are compositions where a $ZrBe_2$ intermetallic or a $TiBe_2$ Laves phase forms. Along the Zr—Ti margin a mixture of α and β Zr or Zr—Ti alloy may be present.

To form a composite with good mechanical properties, a ductile second phase is formed in situ. Thus, the brittle second phases identified in the pseudo-ternary diagram are to be avoided. This leaves a generally triangular region toward the upper left from the $Zr_{42}Ti_{14}X_{44}$ circle where another metal M may be substituted for some of the zirconium and/or titanium to provide a composite with desirable properties. This is reviewed for a substitution of niobium for some of the titanium.

A dashed line is drawn on FIG. 3 toward the 25% titanium composition on the Zr—Ti margin. In the series of compositions along the dashed line, $(Zr_{100-x}Ti_{x-z}M_z)_{100-y}((Ni_{45}Cu_{55}))_{50}Be_{50})_y$ where M=Nb and x=25, increasing z means decreasing the amount of titanium from the original proportion of 75:25. In the portion of the dashed line within the larger oval, the compositions are good bulk glass forming alloys. Once outside the oval, ductile dendrites rich in zirconium form in a composite with an amorphous matrix. These ductile dendrites are formed by chemical partitioning over a wide range of z and y values.

For example, when z=3 and y=25, there is formation of β phase. It has been shown that β phase is formed when z=13.3, extending up to z=20 with y values surrounding 25. Excellent mechanical properties have been found for compositions in the range of z=5 to z=10, with a premier composition where z=about 6.66 along this 75:25 line when M is niobium.

It should be noted that one should not extend along the 75:25 dashed line to less than about 5% beryllium, i.e., where y is less than 10. Below that there is little amorphous phase left and the alloy is mostly dendrites without the desirable properties of the composite.

Consider an alloy series of the form $(Zr_{100100-x}Ti_{x-z}M_z)_{100-y}X_y$ where M is an element that stabilizes the crystalline β phase in Ti- or Zr-based alloys and X is defined as before. To form an in situ prepared bulk metallic glass matrix composite material with good mechanical properties it is important that the secondary crystalline phase, preferentially nucleated on cooling from the high temperature liquid, be a ductile second phase. An example of an in situ prepared bulk metallic glass matrix composite which has exhibited outstanding mechanical properties has the nominal composition $(Zr_{75}Ti_{18.34}Nb_{6.66})_{75}X_{25}$; i.e., an alloy with M=Nb, z=6.66, x=18.34 and y=25. This is along the dashed line of alloys in FIG. 3.

Peaks on an x-ray diffraction pattern (inset in SEM photomicrograph of FIG. 4) for this composition show that the secondary phase present has a body-centered-cubic (bcc) or β phase crystalline symmetry, and that the x-ray pattern peaks are due to the β phase only. A Nelson-Riley extrapolation yields a β phase lattice parameter a=3.496 Å. Thus, upon cooling from the high temperature melt, the alloy undergoes partial crystallization by nucleation and subsequent dendritic growth of the ductile crystalline metal phase in the remaining liquid. The remaining liquid subsequently freezes to the glassy state producing a two-phase microstructure containing β phase dendrites in an amorphous matrix. The final microstructure of a chemically etched specimen is shown in the SEM image of FIG. 4.

SEM electron microprobe analysis gives the average composition for the β phase dendrites (light phase in FIG. 4) to be $Zr_{71}Ti_{16.3}Nb_{10}Cu_{1.8}Ni_{0.9}$. Under the assumption that all of the beryllium in the alloy is partitioned into the matrix, we estimate that the average composition of the amorphous matrix (dark phase) is $Zr_{47}Ti_{12.9}Nb_{2.8}Cu_{11}Ni_{9.6}Be_{16.7}$. Microprobe analysis also shows that within experimental error (about ±1 at. %), the compositions within the two phases do not vary. This implies complete solute redistribution and the establishment of chemical equilibrium within and between the phases.

Figure 4:
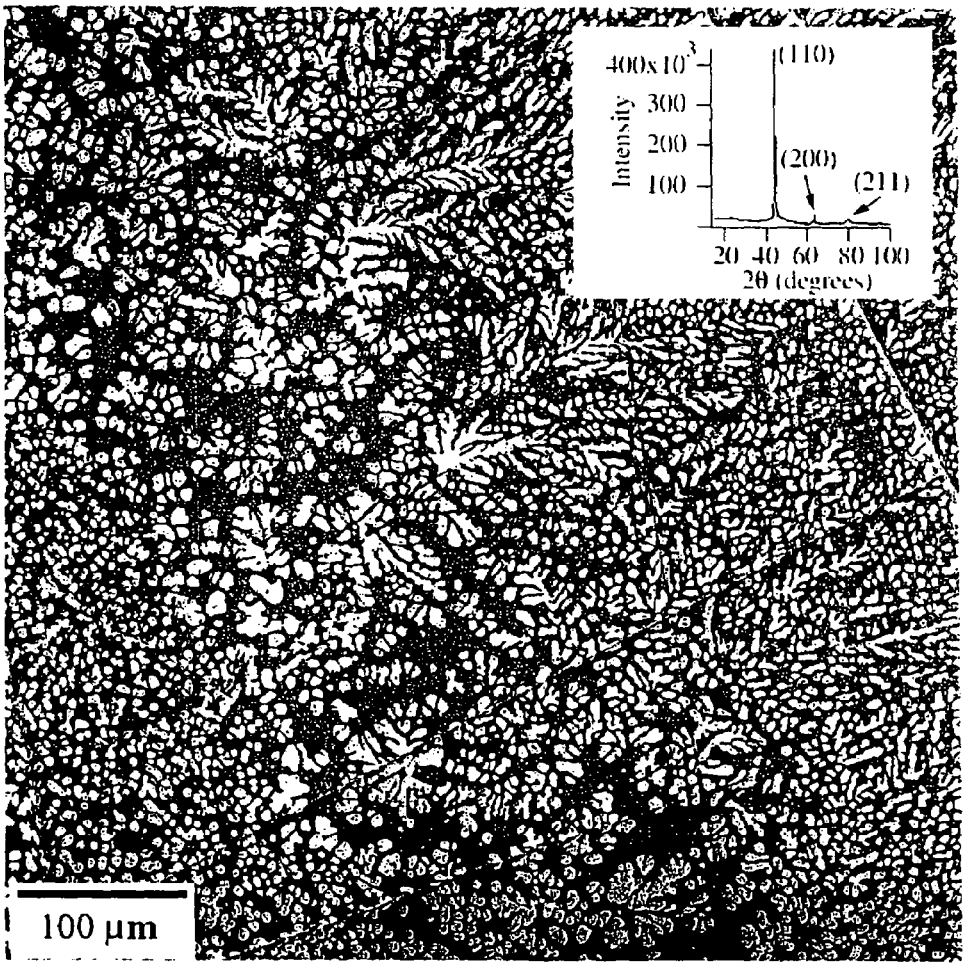
FIG. 4 is an exemplary SEM photomicrograph of an in situ composite formed by chemical partitioning.

Differential scanning calorimetry analysis of the heat of crystallization of the remaining amorphous matrix compared with that of the fully amorphous sample gives a direct estimate of the molar fractions (and volume fractions) of the two phases. This gives an estimated fraction of about 25% β phase by volume and about 75% amorphous phase. Direct estimates based on area analysis of the SEM image agree well with this estimate. The SEM image of FIG. 4 shows the fully developed dendritic structure of the β phase. The dendritic structures are characterized by primary dendrite axes with lengths of 50-150 micrometers and radius of about 1.5-2 micrometers. Regular patterns of secondary dendrite arms with spacing of about 6-7 micrometers are observed, having radii somewhat smaller than the primary axis. The dendrite "trees" have a very uniform and regular structure. The primary axes show some evidence of texturing over the sample as expected since dendritic growth tends to occur in the direction of the local temperature gradient during solidification.

The relative volume proportion of the β phase present in the in situ composite can be varied greatly by control of the chemical composition and the processing conditions. For example, by varying the y value in the alloy series along the dashed line in FIG. 3, $(Zr_{75}Ti_{18.34}Nb_{6.66})_{100-y}X_y$, with M=Nb; i.e., by varying the relative proportion of the early- and late-transition metal constituents; the resultant microstructure and mechanical behavior exhibited on mechanical loading changes dramatically. In situ composites in the Zr—Ti—M—Cu—Ni—Be system have been prepared for alloy series other than the series along the dashed line. These additional alloy series sweep out a region of the quinary composition phase space shown in FIG. 3. The region sweeps in a clockwise direction from a line (not shown) from the V1 alloy composition to the Zr apex of the pseudo-ternary diagram through the dashed line, and extending through to a line (not shown) from the V1 alloy to the Ti apex of the pseudo-ternary diagram, but excluding those regions where a brittle crystalline, quasi-crystalline or Laves phase is stable.

Strategy 2: The Preparation of In Situ Composites by the Mixture of Pure Metal or Metal Alloys with Bulk Metallic Glass Forming Compositions:

As an additional example of the design of in situ composites by chemical partitioning, we discuss the following series of materials. These alloys are prepared by rule of mixture combinations of a metal or metal alloy with a good bulk metallic glass (BMG) forming composition. The formula for such a mixture is given by BMG(100−x)+M(x) or BMG(100−x)+Nb(x), where M=Nb. Preferably, in situ composite alloys of this form are prepared by first melting the metal or metallic alloy with the early transition metal constituents of the BMG composition. Thus, pure Nb metal is mixed via arc melting with the Zr and Ti of the V1 alloy. This mixture is then arc melted with the remaining constituents; i.e., Cu, Ni, and Be, of the V1 BMG alloy. This molten mixture, upon cooling from the high temperature melt, undergoes partial crystallization by nucleation and subsequent dendritic growth of nearly pure Nb dendrites, with β phase symmetry, in the remaining liquid. The remaining liquid subsequently freezes to the glassy state producing a two-phase microstructure containing Nb rich β phase dendrites in an amorphous matrix.

If one starts with an alloy composition with an excess of approximately 25 atomic % niobium above a preferred composition $(Zr_{41.2}Ti_{13.8}Cu_{12.4}Ni_{10.1}Be_{22.5})$ for forming a bulk metallic glass, ductile niobium alloy crystals are formed in an amorphous matrix upon cooling a melt through the region between the liquidus and solidus. The composition of the dendrites is about 82% (atomic %) niobium, about 8% titanium, about 8.5% zirconium, and about 1.5% copper plus nickel. This is the composition found when the proportion of dendrites is about ¼ bcc β phase and ¾ amorphous matrix. Similar behaviors are observed when tantalum is the additional metal added to what would otherwise be a V1 alloy. Besides niobium and tantalum, suitable additional metals which may be in the composition for in situ formation of a composite may include molybdenum, chromium, tungsten and vanadium.

The proportion of ductile bcc forming elements in the composition can vary widely. Composites of crystalline bcc alloy particles distributed in a nominally V1 matrix have been prepared with about 75% V1 plus 25% Nb, 67% V1 plus 33% Nb (all percentages being atomic). The dendritic particles of bcc alloy form by chemical partitioning from the melt, leaving a good glass forming alloy for forming a bulk metallic glass matrix.

Partitioning may be used to obtain a small proportion of dendrites in a large proportion of amorphous matrix all the way to a large proportion of dendrites in a small proportion of amorphous matrix. The proportions are readily obtained by varying the amount of metal added to stabilize a crystalline phase. By adding a large proportion of niobium, for example, and reducing the sum of other elements that make a good bulk metallic glass forming alloy, a large proportion of crystalline particles can be formed in a glassy matrix.

It appears to be important to provide a two phase composite and avoid formation of a third phase. It is clearly important to avoid formation of a third brittle phase, such as an intermetallic compound, Laves phase or quasi-crystalline phase, since such brittle phases significantly degrade the mechanical properties of the composite.

It may be feasible to form a good composite as described herein, with a third phase or brittle phase having a particle size significantly less than 0.1 micrometers. Such small particles may have minimal effect on formation of shear bands and little effect on mechanical properties.

In the niobium enriched Zr—Ti—Cu—Ni—Be system, the microstructure resulting from dendrite formation from a melt comprises a stable crystalline Zr—Ti—Nb alloy, with β phase (body centered cubic) structure, in a Zr—Ti—Nb—Cu—Ni—Be amorphous metal matrix. These ductile crystalline metal particles distributed in the amorphous metal matrix impose intrinsic geometrical constraints on the matrix that leads to the generation of multiple shear bands under mechanical loading.

Sub-standard size Charpy specimens were prepared from a new in situ formed composite material having a total nominal alloy composition of $Zr_{56.25}Nb_5Ti_{13.76}Cu_{6.875}Ni_{5.625}Be_{12.5}$. These have demonstrated Charpy impact toughness numbers that are 250% greater than that of the bulk metallic glass matrix alone; 15 ft-lb. vs. 6 ft-lb. Bend tests have shown large plastic strain to failure values of about 4%. The multiple shear band structures generated during these bend tests have a periodicity of spacing equal to about 8 micrometers, and this periodicity is determined by the β phase dendrite morphology and spacing. In some cast plates with a faster cooling rate, plastic strain to failure in bending has been found to be about 25%. Samples have been found that will sustain a 180° bend.

Figure 5:
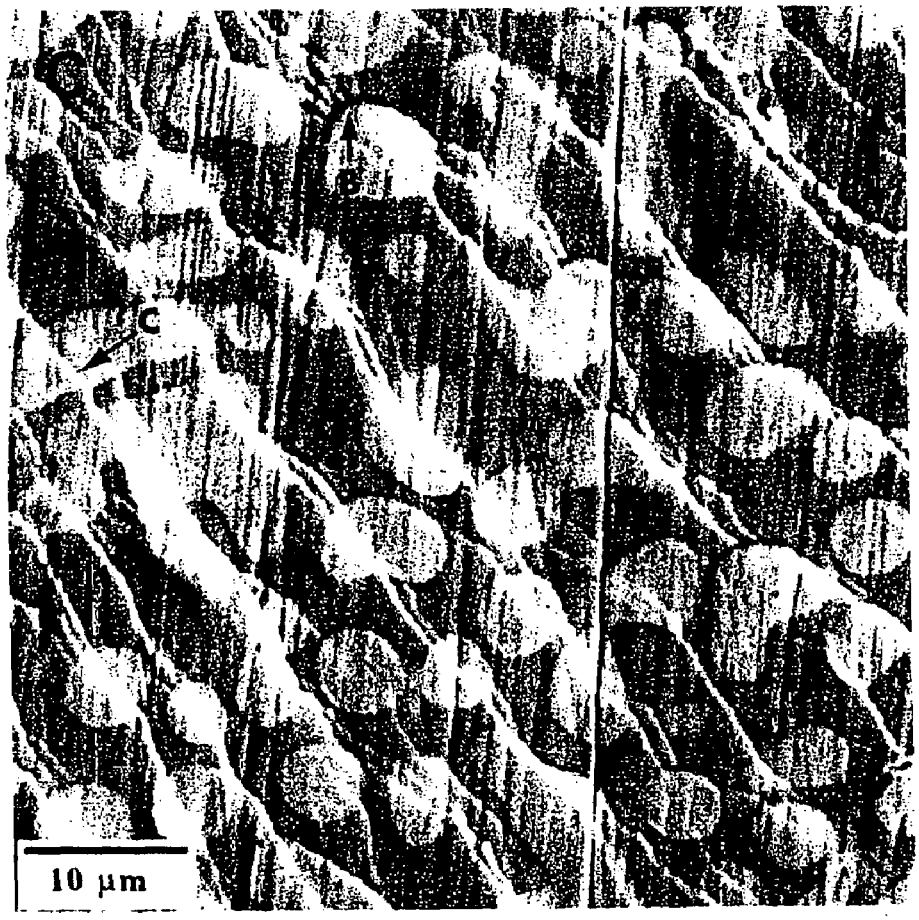
FIG. 5 is an exemplary photomicrograph of such a composite after straining.

In a specimen after straining, as shown in FIG. 5, shear bands can be seen traversing both the amorphous metal matrix phase and the ductile metal dendrite phase. The directions of the shear bands differ slightly in the two phases due to different mechanical properties and probably because of crystal orientation in the dendritic phase.

Shear band patterns as described occur over a wide range of strain rates. A specimen showing shear bands crossing the matrix and dendrites was tested under quasi-static loading with strain rates of about $10^{-4}$ to $10^{-3}$ per second. Dramatically improved Charpy impact toughness values show that this mechanism is operating at strain rates of $10^{-3}$ per second, or higher.

Figure 6:
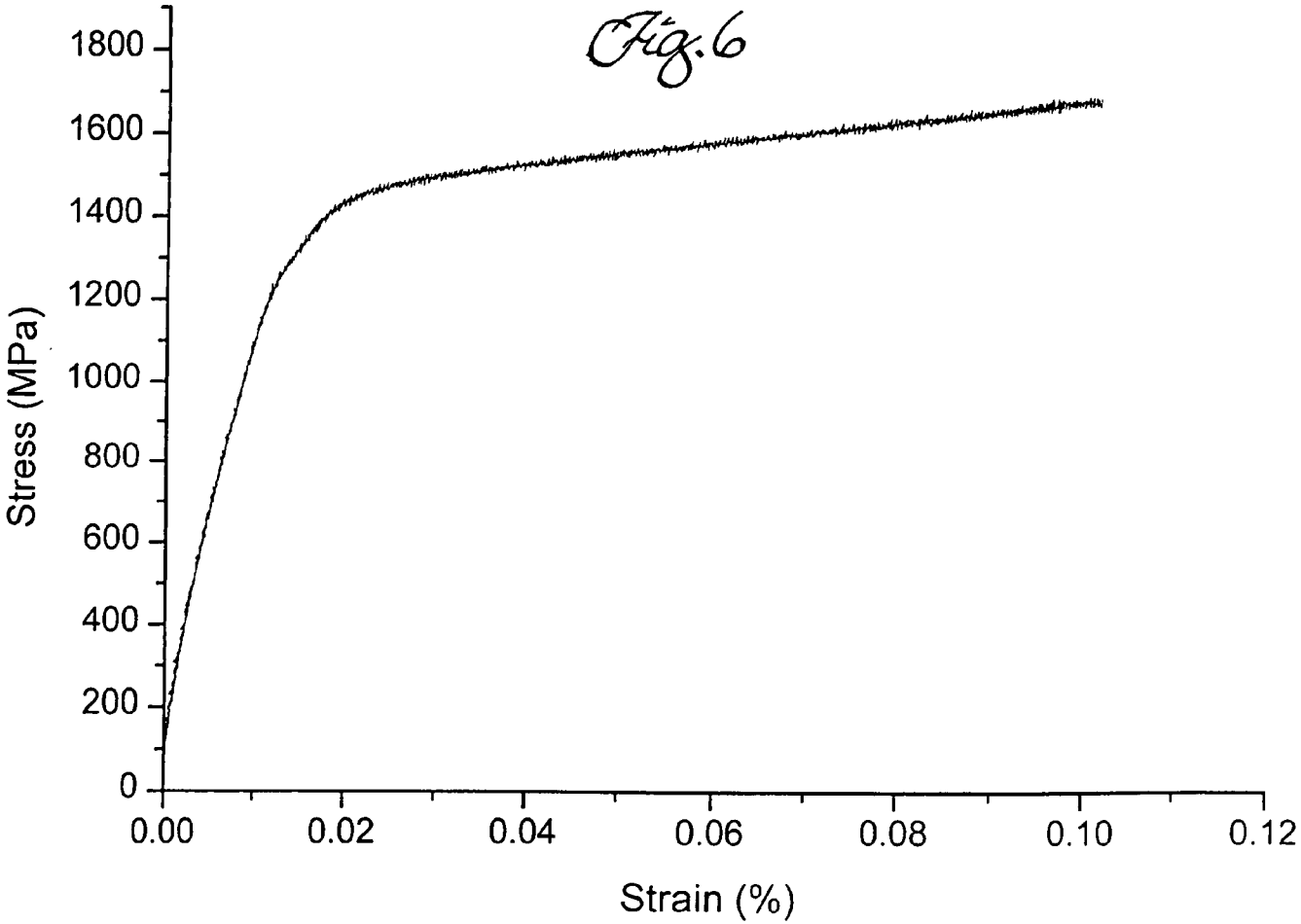
FIG. 6 is a compressive stress-strain curve for such a composite.

Specimens tested under compressive loading exhibit large plastic strains to failure on the order of 8%. An exemplary compressive stress-strain curve as shown in FIG. 6, exhibits an elastic-perfectly-plastic compressive response with plastic deformation initiating at an elastic strain of about 1% and a Young's modulus of about 106 GPa. Beyond the elastic limit the stress-strain curve exhibits a slope $m=d\sigma/d\epsilon$ of about 106 GPa/unit strain>0; where the slope $d\sigma/d\epsilon>0$ implies the presence of significant work hardening. This behavior is not observed in bulk metallic glasses, which normally show strain-softening behavior beyond the elastic limit. These tests were conducted with the specimens unconfined, where monolithic amorphous metal would fail catastrophically. In these compression tests, failure occurred on a plane oriented at about 45° from the loading axis. This behavior is similar to the failure mode of the bulk metallic glass matrix. Plates made with faster cooling rates and smaller dendrite sizes have been shown to fail at about 20% strain when tested in tension.

One may also design good bulk glass forming alloys with high titanium content as compared with the high zirconium content alloys described above. Thus, for example, in the Zr—Ti—M—Ni—Cu—Be alloy system a suitable glass forming composition comprises $(Zr_{100-x}Ti_{x-z}M_z)_{100-y}((Ni_{45}Cu_{55}))_{50}Be_{50})_y$ where x is in the range of from 5 to 95, y is in the range of from 10 to 30, z is in the range of from 3 to 20, and M is selected from the group consisting of niobium, tantalum, tungsten, molybdenum, chromium and vanadium. Amounts of other elements or excesses of these elements may be added for partitioning from the melt to form a ductile second phase embedded in an amorphous matrix.

Experimental results indicate that the β phase morphology and spacing may be controlled by chemical composition and/or processing conditions. This in turn may yield significant improvements in the properties observed; e.g., fracture toughness and high-cycle fatigue. These results offer a substantial improvement over the presently existing bulk metallic glass materials.

Earlier ductile metal reinforced bulk metallic glass matrix composite materials have not shown large improvements in the Charpy numbers or large plastic strains to failure. This is due at least in part to the size and distribution of the secondary particles mechanically introduced into the bulk metallic glass matrix. The substantial improvements observed in the new in situ formed composite materials are manifest by the dendritic morphology, particle size, particle spacing, periodicity and volumetric proportion of the ductile β phase. This dendrite distribution leads to a confinement geometry that allows for the generation of a large shear band density, which in turn yields a large plastic strain within the material.

Another factor in the improved behavior is the quality of the interface between the ductile metal β phase and the bulk metallic glass matrix. In the new composites this interface is chemically homogeneous, atomically sharp and free of any third phases. In other words, the materials on each side of the boundary are in chemical equilibrium due to formation of dendrites by chemical partitioning from a melt. This clean interface allows for an iso-strain boundary condition at the particle-matrix interface; this allows for stable deformation and for the propagation of shear bands through the β phase particles. Previous composites have been made by embedding ductile refractory metal wires or particles in a matrix of glass forming alloy. The interfaces are chemically dissimilar and shear band propagation across the boundaries is inhibited.

The best improvements in mechanical properties of an in situ composite as compared with an amorphous metal, are achieved when the ductile crystalline phase distributed in the amorphous matrix has a natural strain limit above which a significant increase in stress is required for additional strain. This may be found in compositions which undergo a stress driven martensitic transformation, or in compositions which undergo mechanical twinning. In the case of martensite the particles undergo transformation induced plasticity and shear deformation has a strain limit beyond which further transformation does not occur. Once twinning has occurred where an amorphous phase shear band encounters a ductile particle, the strained material does not deform as readily, i.e. additional stress is required for further strain.

Thus, it is desirable to form a composite in which the ductile metal phase included in the glassy matrix has a stress induced martensite transformation. The stress level for transformation induced plasticity, either martensite transformation or twinning, of the ductile metal particles is at or below the shear strength of the amorphous metal phase.

The ductile particles preferably have fcc, bcc or hcp crystal structures, and in any of these crystal structures there are compositions that exhibit stress induced plasticity, although not all fcc, bcc or hcp structures exhibit this phenomenon. Other crystal structures may be too brittle or transform to brittle structures that are not suitable for reinforcing an amorphous metal matrix composite.

This new concept of chemical partitioning is believed to be a global phenomenon in a number of bulk metallic glass forming systems; i.e., in composites that contain a ductile metal phase within a bulk metallic glass matrix, that are formed by in situ processing. For example, similar improvements in mechanical behavior may be observed in $(Zr_{100-x}Ti_{x-z}M_z)_{100-x}(X)y$ materials, where X is a combination of late transition metal elements that leads to the formation of a bulk metallic glass; in these alloys X does not include Be.

It is important that the crystalline phase be a ductile phase to support shear band deformation through the crystalline phase. If the second phase in the amorphous matrix is an intrinsically brittle ordered intermetallic compound or a Laves phase, for example, there is little ductility produced in the composite material. Ductile deformation of the particles is important for initiating and propagating shear bands. It may be noted that ductile materials in the particles may work harden, and such work hardening can be mitigated by annealing, although it is important not to exceed a glass transition temperature that would lose the amorphous phase.

The particle size of the dendrites of crystalline phase can also be controlled during the partitioning. If one cools slowly through the region between the liquidus and processing temperature, few nucleation sites occur in the melt and relatively larger particle sizes can be formed. On the other hand, if one cools rapidly from a completely molten state above the liquidus to a processing temperature and then holds at the processing temperature to reach near equilibrium, a larger number of nucleation sites may occur, resulting in smaller particle size.

The particle size and spacing between particles in the solid phase may be controlled by cooling rate between the liquidus and solidus, and/or time of holding at a processing temperature in this region. This may be a short interval to inhibit excessive crystalline growth. The addition of elements that are partitioned into the crystalline phase may also assist in controlling particle size of the crystalline phase. For example, addition of more niobium apparently creates additional nucleation sites and produces finer grain size. This can leave the volume fraction of the amorphous phase substantially unchanged and simply change the particle size and spacing. On the other hand, a change in temperature between the liquidus and solidus from which the alloy is quenched can control the volume fraction of crystalline and amorphous phases. A volume fraction of ductile crystalline phase of about 25% appears near optimum.

In one example, the solid phase formed from the melt may have a composition in the range of from 67 to 74 atomic percent zirconium, 15 to 17 atomic percent titanium, 1 to 3 atomic percent copper, 0 to 2 atomic percent nickel, and 8 to 12 atomic percent niobium. Such a composition is crystalline, and would not form an amorphous alloy at reasonable cooling rates.

The remaining liquid phase has a composition in the range of from 35 to 43 atomic percent zirconium, 9 to 12 atomic percent titanium, 7 to 11 atomic percent copper, 6 to 9 atomic percent nickel, 28 to 38 atomic percent beryllium, and 2 to 4 atomic percent niobium. Such a composition falls within a range that forms amorphous alloys upon sufficiently rapid cooling.

Upon cooling through the region between the liquidus and solidus at a rate estimated at less than 50 K/sec, ductile dendrites are formed with primary lengths of about 50 to 150 micrometers. (Cooling was from one face of a one centimeter thick body in a water cooled copper crucible.) The dendrites have well developed secondary arms in the order of four to six micrometers wide, with the secondary arm spacing being about six to eight micrometers. It has been observed in compression tests of such material that shear bands are equally spaced at about seven micrometers. Thus, the shear band spacing is coherent with the secondary arm spacing of the dendrites.

In other castings with cooling rates significantly greater, probably at least 100 K/sec, the dendrites are appreciably smaller, about five micrometers along the principal direction and with secondary arms spaced about one to two micrometers apart. The dendrites have more of a snowflake-like appearance than the more usual tree-like appearance. Dendrites seem less uniformly distributed and occupy less of the total volume of the composite (about 20%) than in the more slowly cooled composite. (Cooling was from both faces of a body 3.3 mm thick.) In such a composite, the shear bands are more dense than in the composite with larger and more widely spaced dendrites. It is estimated that in the first composite about four to five percent of the volume is in shear bands, whereas in the "finer grained" composite the shear bands are from two to five times as dense. This means that there is a greater amount of deformed metal, and this is also shown by the higher strain to failure in the second composite.

The direction of a primary dendrite is determined by the local temperature gradient present during solidification. The principal dendrite axes extend in the direction of the temperature gradient, nucleating at the cooler regions and propagating toward the warmer regions as cooling progresses. Secondary arms form transverse to the principal axis and generally are skewed away from the cooler regions. In other words, the dendrite is somewhat like the fletching on an arrow and the pointed end is toward the direction from which heat is extracted.

The individual shear bands that form upon mechanical loading tend to propagate along the principal direction of the dendrites and across the secondary dendrite arms. The planes formed by these bands tend to run along the primary dendrite axes. Thus, the orientation of the dendrites influences the direction of strain in the composite and the direction of failure. One can, therefore, influence the direction of strain and failure by controlling the orientation of the dendrites.

It will also be realized that directions of externally applied stress also influence the direction of shear band formation and may override the tendency to propagate along the principal direction of the dendrites. Knowing how shear bands tend to propagate gives the designer an opportunity to enhance the properties of a composite object in regions of critical stress by appropriately controlling the morphology of the dendrites, not only in their orientation, but also in size.

As used herein, when speaking of particle size or particle spacing, the intent is to refer to the width and spacing of the secondary arms of the dendrites, when present. In absence of a dendritic structure, particle size would have its usual meaning, i.e. for round or nearly round particles, an average diameter. It is also possible that acicular or lamellar ductile metal structures may be formed in an amorphous matrix. Width of such structures is considered as particle size. It will also be noted that the secondary arms in a dendritic are not uniform width; they taper from a wider end adjacent the principal axis toward a pointed or slightly rounded free end. Thus, the "width" is some value between the ends in a region where shear bands propagate. Similarly, since the arms are wider at the base, the spacing between arms narrows at that end and widens toward the tips. Shear bands seem to propagate preferentially through regions where the width and spacing are about the same magnitude. The dendrites are, of course, three dimensional structures and the shear bands are more or less planar, so this is only an approximation.

When referring to particle spacing, the center-to-center spacing is intended, even if the text may inadvertently refer to the spacing in a context that suggests edge-to-edge spacing.

One may also control particle size by providing artificial nucleation sites distributed in the melt. These may be minute ceramic particles of appropriate crystal structure or other materials insoluble in the melt. Agitation may also be employed to affect nucleation and dendrite growth. Cooling rate techniques are preferred since repeatable and readily controlled.

It appears that the improved mechanical properties can be obtained from such a composite material where the second ductile metal phase embedded in the amorphous metal matrix, has a particle size in the range of from about 0.1 to 15 micrometers. If the particles are smaller than 100 nanometers, shear bands may effectively avoid the particles and there is little if any effect on the mechanical properties. If the particles are too large, the ductile phase effectively predominates and the desirable properties of the amorphous matrix are diluted. Preferably, the particle size is in the range of from 0.5 to 8 micrometers since the best mechanical properties are obtained in that size range. The particles of crystalline phase should not be too small or they are smaller than the width of the shear bands and become relatively ineffective. Preferably, the particles are slightly larger than the shear band spacing.

The spacing between adjacent particles should be in the range of from 0.1 to 20 micrometers. Such spacing of a ductile metal reinforcement in the continuous amorphous matrix induces a uniform distribution of shear bands throughout a deformed volume of the composite, with strain rates in the range of from about $10^{-4}$ to $10^{-3}$ per second. Preferably, the spacing between particles is in the range of from 1 to 10 micrometers for the best mechanical properties in the composite.

The volumetric proportion of the ductile metal particles in the amorphous matrix is also significant. The ductile particles are preferably in the range of from 5 to 50 volume percent of the composite, and most preferably in the range of from 15 to 35% for the best improvements in mechanical properties. When the proportion of ductile crystalline metal phase is low, the effects on properties are minimal and little improvement over the properties of the amorphous metal phase may be found. On the other hand, when the proportion of the second phase is large, its properties dominate and the valuable assets of the amorphous phase are unduly diminished.

There are circumstances, however, when the volumetric proportion of amorphous metal phase may be less than 50% and the matrix may become a discontinuous phase. Stress induced transformation of a large proportion of in situ formed crystalline metal modulated by presence of a smaller proportion of amorphous metal may provide desirable mechanical properties in a composite.

The size of and spacing between the particles of ductile crystalline metal phase preferably produces a uniform distribution of shear bands having a width of the shear bands in the range of from about 100 to 500 nanometers. Typically, the shear bands involve at least about four volume percent of the composite material before the composite fails in strain. Small spacing is desirable between shear bands since ductility correlates to the volume of material within the shear bands. Thus, it is preferred that there be a spacing between shear bands when the material is strained to failure in the range of from about 1 to 10 micrometers. If the spacing between bands is less than about ½ micrometer or greater than about 20 micrometers, there is little toughening effect due to the particles. The spacing between bands is preferably about two to five times the width of the bands. Spacings of as much as 20 times the width of the shear bands can produce engineering materials with adequate ductility and toughness for many applications.

In one example, when the band density is about 4% of the volume of the material, the energy of deformation before failure is estimated to be in the order of 23 joules (with a strain rate of about $10^2$ to $10^3$/sec in a Charpy-type test. Based on such estimates, if the shear band density were increased to 30 volume percent of the material, the energy of deformation rises to about 120 joules.

It is also desirable that the crystalline phase have a modulus of elasticity approximately the same as the modulus of elasticity of the amorphous metal. This assures a reasonably uniform distribution of the shear bands. Preferably, the modulus of elasticity of the crystalline metal phase is in the range of from 50 to 150 percent of the modulus of elasticity of the amorphous metal alloy. If the modulus of the particles is too high, the interface between the particles and amorphous matrix has a high stress differential and may fail in shear. Some high modulus particles can break out of the matrix when the composite is strained.

For alloys usable for making objects with dimensions larger than micrometers, cooling rates from the region between the liquidus and solidus of less than 1000 K/sec are desirable. Preferably, cooling rates to avoid crystallization of the glass forming alloy are in the range of from 1 to 100 K/sec or lower. For identifying acceptable glass forming alloys, the ability to form layers at least 1 millimeter thick has been selected. In other words, an object having an amorphous metal matrix has a thickness of at least one millimeter in its smallest dimension.

Figure 7:
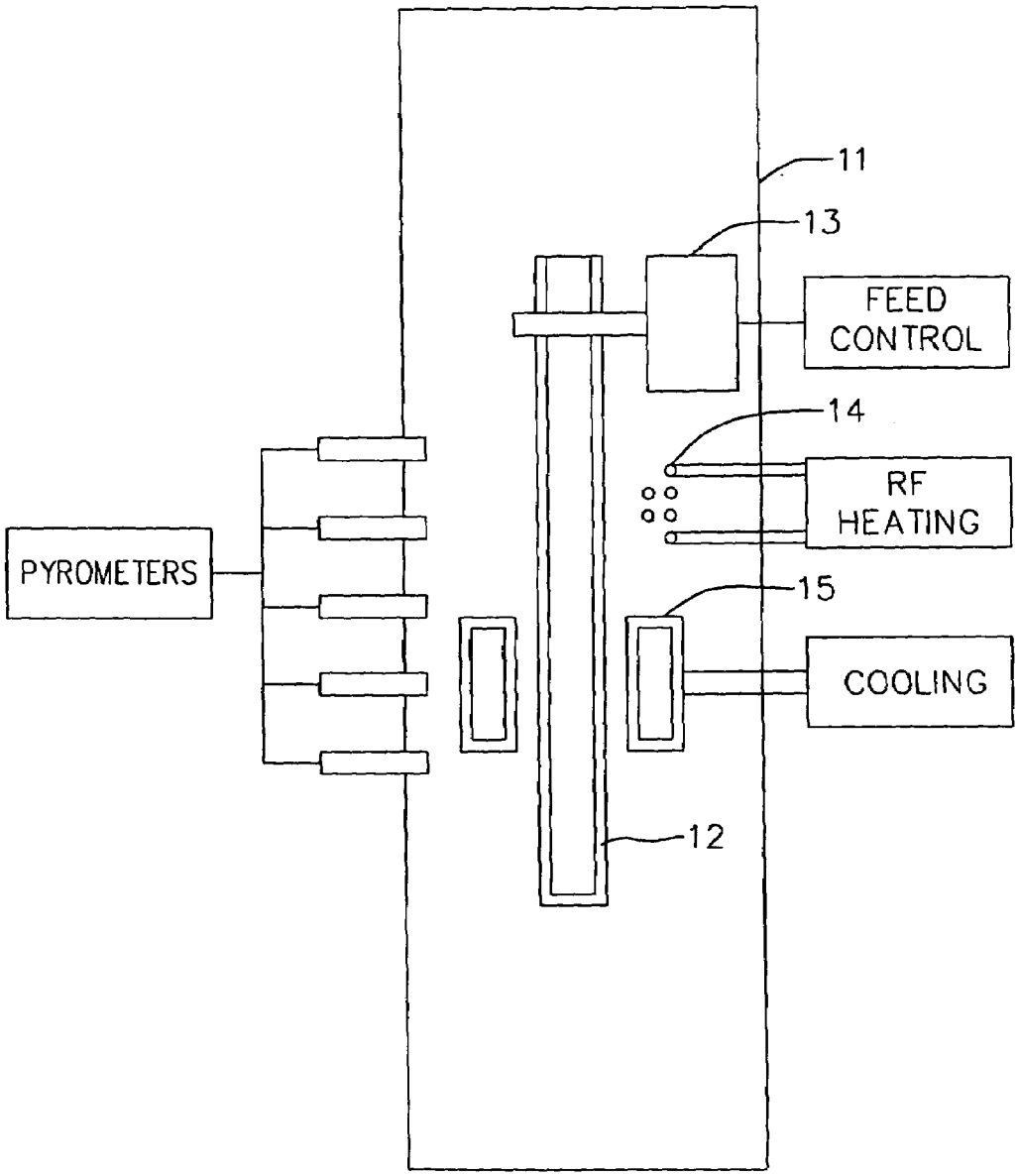
FIG. 7 is a schematic illustration of a technique for forming a composite with oriented microstructure.

FIG. 7 illustrates schematically a technique for controlling orientation of the dendritic structure formed during chemical partitioning of a ductile metal phase in an amorphous matrix. In this embodiment a controlled temperature gradient is established by directional solidification from one end of an elongated member so that subsequently formed dendrites tend to be oriented similarly to previously formed dendrites. The process is conducted in a vacuum chamber 11 to protect the reactive materials from oxidation or other contamination. An elongated vessel 12, such as a quartz tube, extends vertically in the vacuum chamber and is mounted on a feed mechanism 13 for gradual lowering through the chamber. The tube descends through an RF induction coil 14 which is used to heat an alloy contained in the tube to a temperature above its melting point.

The tube then descends through one or more cooling sleeves 15 which extract heat from the tube and alloy to initially cause partitioning and precipitation of dendrites of crystalline metal alloy from the melt. Upon further cooling the remaining melt solidifies to form an amorphous matrix surrounding the particles of ductile refractory metal. The resulting composite has dendrites oriented preferentially due to the directional solidification along the length of the metal contained in the tube. The dendrites are more or less coherent in that the principal directions of the dendrites are roughly aligned.

If desired, an additional induction heating zone may be included before the cooling sleeve for holding the alloy at a processing temperature where formation of dendrites proceeds at a controlled rate. Thus, particle size, spacing, periodicity and orientation can be controlled by both the rate of descent from the molten zone to the cooling zone and also by holding at an intermediate elevated temperature between the liquidus and solidus of the alloy.

Other techniques may be used for assuring or controlling a temperature gradient in the alloy as it cools form the melt. For example, an entire volume of metal may be melted and a temperature gradient applied by differential cooling in different portions of the melt, particularly as the alloy passes through the temperature region between the liquidus and solidus. This could take the form of cooling from only a selected surface area, for example, or by extracting heat from different areas of the surface at different rates. A plate- or sheet-like casting may be cooled preferentially from one face for selectively orienting dendrites in the composite structure, for example, or an elongated article may be cooled from an end face for axial orientation.

This gives the designer an opportunity to control dendrite morphology in complex geometry parts by controlling not only the chemistry of the alloy, but also the cooling rate and direction in the temperature range between the liquidus and solidus. By increasing cooling rate, the strain to failure can be increased and by controlling direction, the orientation of dendrites can be biased toward orientations that enhance properties of the composite. Cold working the composite, such as by cold rolling, can also induce desirable texture.

Composites prepared by mechanically adding wires, whiskers or particles to a bulk metallic glass forming alloy do not exhibit the improvements in mechanical behavior observed in the new materials. Previously, the composite reinforcement was added to the bulk metallic glass alloy by melting the glass-forming metal and introducing pieces of reinforcement into the molten alloy, which is then solidified at a rate sufficiently high that the metal matrix is amorphous. Alternatively, a mass of pieces of the reinforcement material are infiltrated under positive gas pressure by the molten glass-forming alloy and then cooled.

Both of these methods lack sufficient control of the secondary reinforcing particle size and spacing needed to adequately constrain the bulk metallic glass matrix such that multiple shear bands are formed during mechanical loading. The interfaces between the particles and matrix are not chemically homogeneous, leading to higher internal energy and less effective strain transfer. The in situ formed two-phase microstructure, interface homogeneity, dendritic morphology, particle size, and/or particle spacing of the new composites is responsible for the improved mechanical behavior.

The principles of in situ formation of a composite by partitioning of the metals in a melt as it is cooled may be used to form a dual composite. For example, a bundle of tungsten wires may be infiltrated with a molten alloy selected from those described above. The combination is then cooled to a processing temperature below the liquidus of the molten alloy and above the glass transition temperature. A crystalline metal phase forms from this melt, depleting the melt of some of its elements. The combination is then cooled sufficiently rapidly to form an amorphous metal matrix around the metal phases. Thus, a composite formed in situ serves as a matrix for the embedded tungsten wires. The same principles may be used for infiltrating other arrays or materials. Likewise, a reinforcing phase may be stirred into a melt that is cooled to form a precipitated phase by partitioning and further cooled to form an amorphous matrix. Either way, one may form a three-phase composite of a reinforcing metal in a matrix that is a composite itself.

What is claimed is:

1. A reinforced amorphous metal object comprising:

an amorphous metal alloy forming a substantially continuous matrix; and a second ductile metal phase embedded in the matrix and formed in situ in the matrix by crystallization from a molten alloy.

2. A composite amorphous metal object as recited in claim 1 wherein the second phase is in the form of particles precipitated in situ from nucleation sites distributed in a melt comprising the amorphous metal alloy and second phase alloy.

3. A composite amorphous metal object as recited in claim 1 wherein the second phase comprises in the range of from 5 to 50 volume percent of the composite.

4. A composite amorphous metal object as recited in claim 1 wherein the second phase comprises in the range of from 15 to 35 volume percent of the composite.

5. A reinforced composite amorphous metal object comprising:

an amorphous metal alloy forming a substantially continuous matrix; and a second ductile metal phase embedded in the matrix and formed in situ in the matrix by crystallization from a molten alloy, wherein the second phase is formed from a molten alloy having an original composition in the range of from 52 to 68 atomic percent zirconium, 3 to 17 atomic percent titanium, 2.5 to 8.5 atomic percent copper, 2 to 7 atomic percent nickel, 5 to 15 atomic percent beryllium, and 3 to 20 atomic percent niobium.

6. A reinforced composite amorphous metal object comprising:

an amorphous metal alloy forming a substantially continuous matrix; and a second ductile metal phase embedded in the matrix and formed in situ in the matrix by crystallization from a molten alloy, wherein the second phase is sufficiently spaced apart for inducing a uniform distribution of shear bands throughout a deformed volume of the composite, the shear bands involving at least four volume percent of the composite before failure in strain and traversing both the amorphous metal phase and the second phase.

7. A reinforced composite amorphous metal object comprising:

an amorphous metal alloy forming a substantially continuous matrix; and a second ductile metal phase embedded in the matrix and formed in situ in the matrix by crystallization from a molten alloy, wherein the second phase comprises particles having a particle size in the range of from 0.1 to 15 micrometers.

8. A composite amorphous metal object as recited in claim 7 wherein the second phase comprises particles having a particle size in the range of from 10 to 15 micrometers.

9. A reinforced composite amorphous metal object comprising:

an amorphous metal alloy forming a substantially continuous matrix; and a second ductile metal phase embedded in the matrix and formed in situ in the matrix by crystallization from a molten alloy, wherein the second phase comprises particles having a spacing between adjacent particles in the range of from 0.1 to 20 micrometers.

10. A composite amorphous metal object as recited in claim 9 wherein the spacing between adjacent particles in the range of from 1 to 10 micrometers.

11. A reinforced composite amorphous metal object comprising:

an amorphous metal alloy forming a substantially continuous matrix; and a second ductile metal phase embedded in the matrix and formed in situ in the matrix by crystallization from a molten alloy, wherein second phase is in the form of dendrites.

12. A reinforced composite amorphous metal object comprising:

an amorphous metal alloy forming a substantially continuous matrix; and a second ductile metal phase embedded in the matrix and formed in situ in the matrix by crystallization from a molten alloy, wherein the volumetric proportion of the amorphous metal phase is less than 50%.

13. A reinforced composite amorphous metal object comprising:

an amorphous metal alloy forming a substantially continuous matrix; and a second ductile metal phase embedded in the matrix and formed in situ in the matrix by crystallization from a molten alloy, wherein above the elastic limit a stress-strain curve of the composite amorphous metal alloy and ductile metal phase exhibits a slope $d\sigma/d\epsilon>0$, wherein $\sigma$ is stress and $\epsilon$ is strain.

* * * * *